US005664719A

United States Patent [19]

Bigham et al.

[11] Patent Number: 5,664,719

[45] Date of Patent: Sep. 9, 1997

[54] SKATE CARRIER WITH RETRACTABLE STRAP

[75] Inventors: David Wynn Bigham, Minnetonka; George David Stickler, Shorewood, both of Minn.

[73] Assignee: David W. Bigham, Minnetonka, Minn.

[21] Appl. No.: 589,413

[22] Filed: Jan. 22, 1996

[51] Int. Cl.[6] ..... A45F 4/00; A45F 5/00

[52] U.S. Cl. ..... 224/577; 224/580; 224/250; 224/257; 224/678; 294/163; 294/164; 294/143; 294/146

[58] Field of Search ..... 224/577, 580, 224/250, 257, 258, 678; 294/162, 163, 164, 165, 159, 143, 146, 147, 150, 151, 167, 168, 141

[56] References Cited

U.S. PATENT DOCUMENTS

| | | | |
|---|---|---|---|
| D. 252,595 | 8/1979 | Rogers . | |
| D. 335,576 | 5/1993 | Phillpott . | |
| D. 352,173 | 11/1994 | Tirone et al. . | |
| D. 352,174 | 11/1994 | Mazzarisi et al. . | |
| 2,353,809 | 7/1944 | Carson . | |
| 4,160,301 | 7/1979 | Woolley . | |
| 4,394,042 | 7/1983 | Smith . | |
| 4,488,748 | 12/1984 | Burkes | 294/147 |
| 4,629,103 | 12/1986 | Miller | 294/164 |
| 4,729,591 | 3/1988 | Scalise . | |
| 4,779,362 | 10/1988 | Citrowske . | |
| 4,863,083 | 9/1989 | Chen | 224/250 |
| 4,867,359 | 9/1989 | Donovan . | |
| 4,942,994 | 7/1990 | Sterenberg . | |
| 5,249,723 | 10/1993 | Lamadelein . | |
| 5,269,580 | 12/1993 | Hsiao | 294/162 |
| 5,285,939 | 2/1994 | Hogan | 224/250 |
| 5,316,192 | 5/1994 | Ng . | |

*Primary Examiner*—Linda J. Sholl
*Attorney, Agent, or Firm*—Merchant, Gould, Smith, Edell, Welter, & Schmidt, P.A.

[57] ABSTRACT

The present invention is directed to an apparatus for carrying in-line skates. The in-line skates have blades that include at least two adjacent wheels. The apparatus comprises a base member having a front, back and bottom. The base member defines first and second slots, each open to the bottom and extending from the front to the back. The first and second slots are each sized to receive the blade of an in-line skate so that the base member is substantially perpendicular to the in-line skate blades.

14 Claims, 1 Drawing Sheet

SKATE CARRIER WITH RETRACTABLE STRAP

TECHNICAL FIELD

The present invention relates to an apparatus for carrying skates, and more particularly to an apparatus for carrying in-line skates.

BACKGROUND

In-line skating has become a very popular sport. People of all ages use in-line skates for leisure, exercise and competitive sports such as hockey. However, avid in-line skaters do not usually use their skates at home. Rather, they typically carry them to a park that has appropriate conditions such as an asphalt paths. The difficulty is that in-line skates are bulky and difficult to handle when not skating.

Some people even use in-line skates as a combined form of exercise and transportation around the city—much like a bicycle. However, many stores, restaurants, and other business do not allow people to wear in-line skates on their premises. As a result, people must carry their shoes while they are skating, which can be burdensome.

Furthermore, people that are avid in-line skaters also tend to have an interest in ice skating. For example, many children that play ice hockey in the winter might also play street hockey with in-line skates in the summer. Ice skates are also difficult to handle when carrying them to an ice-skating rink.

People have designed various types carriers in an effort to make carrying in-line or ice skates more manageable. For example, one device for carrying in-line skates has a pair of channel irons sized to receive the entire length of the in-line skate blade. A handle is attached to the channel irons and extends upward. The handle is taller than the combined height of the boot and the blade.

The difficulty with such a device is that it is bulky and difficult to store. Additionally, such a bulky device cannot be carried with the person while they are skating. As a result, it must be left unattended and is easily stolen. Another shortcoming is that such a device is adaptable to carry ice skates. Thus, an avid skater would need two carriers, one for ice-skates and one for in-line skates.

Other people have designed boot carriers. However, many of these boot carriers have a flat surface on which the sole of the boot can rest. Such a carrier is not configured to securely hold a boot that has a blade such as in-line skates or ice skates. Other boot carriers are merely composed from straps that can be difficult to put on the boots. Furthermore, such straps can easily become tangled.

There are also carriers that are configured to carry ice skates. However, ice-skate carriers typically define slots that are configured to receive the entire length of the skate blade.

Such ice-skate carriers are not appropriate for in-line skates. The reason is that blades for in-line skates are large and bulky. A corresponding carrier that is configured to receive the length of an in-line skate blade also would be large and bulky. Such a carrier would be heavy, difficult to manage, and defeat the purpose of having a carrier. Also, such slots would be so large that they could not also accommodate ice-skate blades. Again, an avid skater would require two carriers, one for their ice skates and one for their in-line skates.

Therefore, there is a need in the art for a carrier that has slots sized to receive in-line skate blades, but is still lightweight, compact, and easy to carry. There is a further need in the art for an in-line skate carrier that a person can easily carry while they are skating. Such a carrier might also allow a person to carry their street shoes while they are skating. There is a further need in the art for a carrier that is versatile and allows a person to carry either in-line skates or ice skates.

SUMMARY

The present invention is directed to an apparatus for carrying in-line skates. The in-line skates have blades that include at least two adjacent wheels. The apparatus includes a base member having a front, back, and bottom. The base member defines first and second slots, each open to the bottom and extending from the front to the back. The first and second slots are each sized to receive the blade of an in-line skate so that the base member is substantially perpendicular to the in-line skate blades. The base member further defines first and second strap slots. The first and second strap slots each have a first end open proximal to the bottom and a second open proximal to the top. A strap has first and second end portions operably connected to the base member. The strap has a first boot portion extending across the first slot, an internal portion extending through the first strap slot, a handle portion proximal to the top of the base member, a second internal portion extending through the second strap slot, and a second boot portion extending across the second slot.

DETAILED DESCRIPTION

Figure 2:
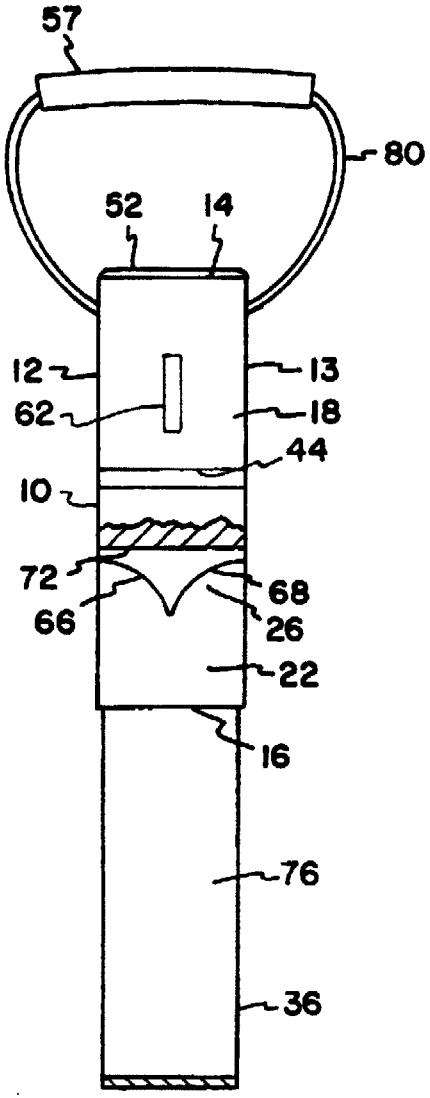
FIG. 2 is a side elevational view of the present invention shown in FIG. 1 with a breakout showing the V-shaped inner surface of a slot sized to receive an in-line skate blade.

A preferred embodiment of the present invention will be described in detail with reference to the drawing, wherein like reference numerals represent like parts and assemblies throughout the several views. Reference to the preferred embodiment does not limit the scope of the invention, which is limited only by the scope of the claims attached hereto.

Figure 1:
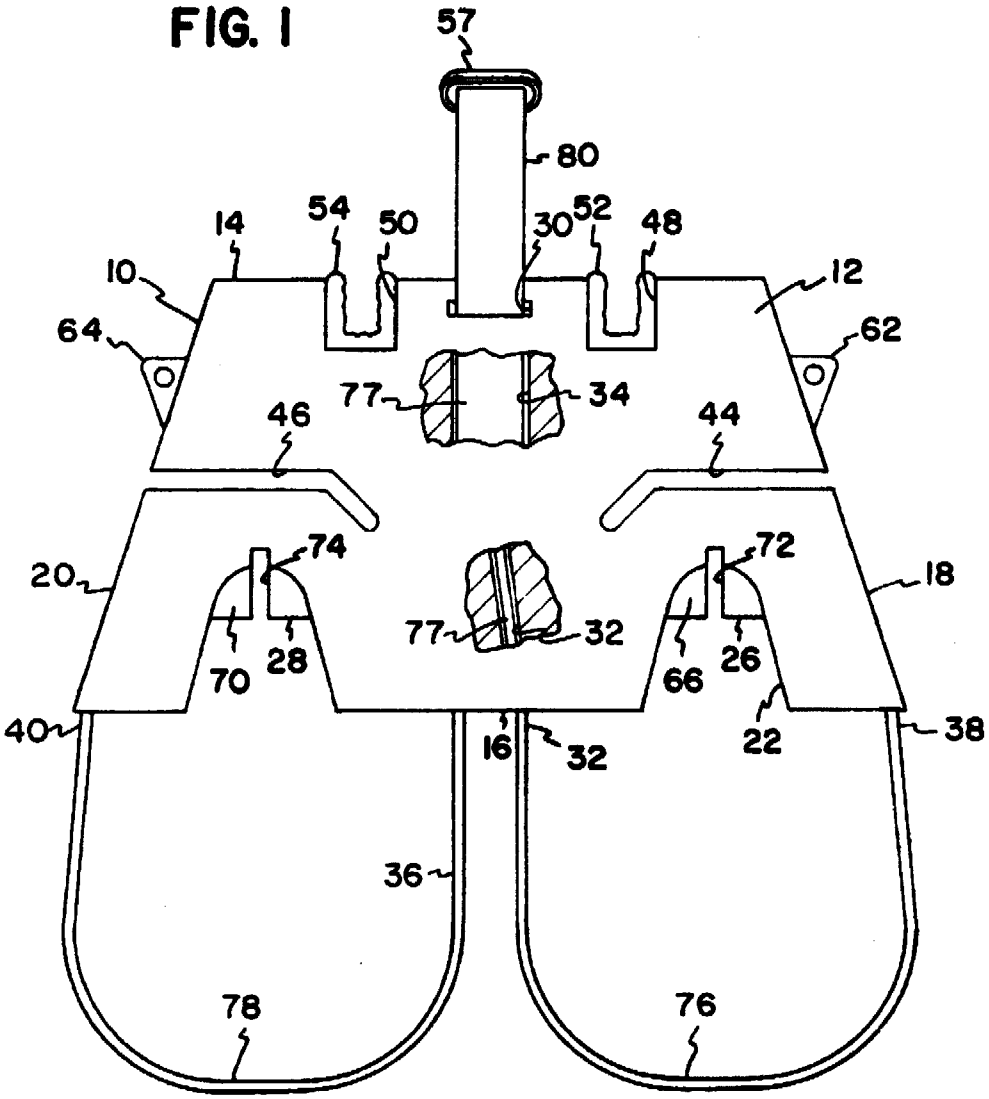
FIG. 1 is front elevational view of the present invention with a breakout showing a slot defined in the base unit that provides a passage for a strap.

Referring to FIGS. 1 and 2, the present invention includes a base member 10 having a front 12, rear 13, bottom 14, top 16, and oppositely disposed sides 18 and 20. First and second slots 22 and 24 are defined in base number 10 and are open to bottom 16. Additionally, the first and second slots 22 and 24 each extend from the front 12 to the rear 13 of the base member 10. The base member 10 can be made from a variety of materials including a durable, light-weight plastic.

The base member 10 has first and second inner surfaces 26 and 28 that form the upper portion of the first and second slots 22 and 24, respectively. The first inner surface 26 is configured to fit between adjacent wheels on an in-line skate blade. In particular, first inner surface 26 is V-shaped so that it has first and second angled portions 66 and 68. Each angled portion 66 and 68 is concave so that the angled portions 66 and 68 conform to the curvature of adjacent in-line skate wheels.

Second inner surface 28 is substantially similar to first inner surface 26 and is V-shaped thereby defining third and fourth angle portions 70 and (not shown). Third and fourth angled portions 70 and (not shown) are concave and conform to the shape of the adjacent in-line skate wheels.

Additionally, base member 10 defines a first inner or ice-skate slot 72 that extends from the front 12 to the rear 13 and is open to the first inner surface 26. First inner slot 72 is sized to receive the blade of an ice skate. Similarly, base member 10 defines a second inner or ice-skate slot 74 that extends from the front 12 to the rear 13 and is open to the second inner surface 28. Second inner slot 74 is also sized to receive the blade of an ice skate.

In an alternative embodiment, first inner or ice-skate slot 72 can be positioned next to first slot 22 and open to bottom 16 rather than first inner surface 26. Similarly, second inner or ice-skate slot 74 can be positioned next to second slot 24 and open to bottom 16 rather than second inner surface 28.

A first strap slot 30 is defined in base member 10 and extend from the bottom 16 to the front 12 near the top 14. The first strap slot 30 is proximal to the front 12. Near the bottom 16, the first strap slot 30 has a lower portion 32 that is substantially perpendicular to the front 12. Additionally, the first strap slot 30 twists so that near the top 14, the first strap slot has an upper portion 34 that is substantially parallel to the front 12.

A second strap slot (not shown) is also defined in the base member 10 and is substantially similar to the first strap slot 30. The second strap slot is proximal to the rear 13. Near the bottom 16, the second strap slot has a lower portion (not shown) that is substantially perpendicular to the rear 13. Additionally, the second strap slot twists so that near the top 14, the second strap slot has an upper portion (not shown) that is substantially parallel to the rear 13.

A strap 36 has a first end portion 38 and a second, oppositely-disposed end portion 40. The first end portion 38 is operably connected to the bottom 16 near the side 16. The strap 36 then extends across the first slot, upward through the first strap slot 30, out of the upper portion 34 of the first strap slot 30 and over the top 14 of the base member 10, downward through the second strap slot, out of the second strap slot at the bottom 16 of base member 10, and across the second slot 24. The second oppositely disposed end portion 40 is then operably connected to the bottom 16 of the base member 10 near the side 18.

The strap 36 has a first boot portion 76 that extends across the first slot 22, a first internal portion 77 that extends through first strap slot 30, a handle portion 80 that extends across the top 14 of base member 10, a second internal portion (not shown) that extends through second strap slot, and a second boot portion 78 that extends across the second slot 24. A pad 57 is wrapped around the handle portion 80 of the strap 36.

In order to use base member 10 to carry in-line skates, the user can insert an in-line skate blade from one skate into first slot 22 so that first inner surface 26 is positioned between adjacent wheels. The user can then insert an in-line skate blade from the other skate into the second slot 24 so that the second inner surface 28 is positioned between adjacent wheels. Finally, the user pulls up on the handle portion 80 of the strap 36, which causes the strap 36 to pull tightly around the boots of the in-line skates and secure them to the base member 10. The base member 10 and hence the skates are then easily carried by lifting on the handle portion 80 of the strap 36.

In this position, base member 10 is positioned perpendicular to the blades of the in-line skates. Additionally, first and second inner surfaces 26 and 28 prevent base member 10 from sliding along the length of the in-line skate blades.

Ice skates are connected to the base member in a substantially similar manner. The primary difference is that the ice skate blades are placed in the first and second inner slots 72 and 74.

In order to prevent the strap from inadvertently loosening, one skilled in the art will realize that clips could be attached to the strap 36 in order to prevent the strap 36 from sliding downward through the first and second strap slots 30 and (not shown) and thus loosening around the boots of the skates.

The present invention has many advantages. For example, because the slots are oriented so that the base unit is positioned perpendicular to the blades, the carrier needs to be made from only a minimal amount of material. As a result, it is light weight and compact. As a result a person can easily carry the base member 10 while skating, can easily throw the carrier and skates into a duffel bag with other equipment such as hockey gear, and can easily store the carrier when not is use.

In addition to being light-weight and compact, the carrier is advantageous because it securely holds the skates together and keeps them from twisting relative to one another. As a result, skates are much easier to carry.

Having one set of slots sized for ice skates and another set of slots sized for in-line skates is also advantageous. Such an embodiment makes the carrier versatile so that it can be used all year long. Furthermore, there is added versatility because the same strap can be used to secure the skate boot regardless of the whether it is an ice skate or an in-line skate. This versatility results from the close proximity of the slots for receiving in-line skate blades and the slots for receiving ice-skate blades.

Additionally, first and second hockey-stick slots 48 and 50 are defined in base member 10 and extend from the front 12 to the rear 13. The first and second hockey-stick slots 48 and 50 can be positioned so that they are open to top 14. Additionally, first and second liners 52 and 54 are positioned within first and second hockey stick slots 48 and 50, respectively. The first and second hockey-stick slots 48 and 50 are sized to receive a hockey stick handle. The first and second liners 52 and 54 are made from a compliant material such as rubber that will conform to the shape and size of the hockey-stick handle. Thus, the first and second liners will help to secure the hockey stick handles in the first and second hockey-stick slots 48 and 50. One advantage of this embodiment is that both skates and hockey sticks can be carried in one hand.

A first flange 62 is operably connected to the side 18 of base member 10. A second flange 64 is operably connected to the oppositely-disposed side 20 of base member 10. A person can attach either a shoulder strap (not shown) or a waist straps(not shown) to the first and second flanges 62 and 64. Additionally, base member 10 can define a compartment for storing such a shoulder or waist strap.

A waist strap is useful when the person is skating. They could easily carry base member 10 with them much like a fanny pack. Additionally, the base member 10 defines first and second shoe-lace slots 44 and 46. The first shoe-lace slot 44 extends from the front 12 to the rear 13 of base member 10 and is open to the side 18. The second shoe-lace slot 46 extends from the front 12 to the rear 13 of base member 10 and is open to the side 20. A person could attach their street shoes to base member 10 by sliding their tied shoe laces through first and second shoe-lace slots 44 and 46. Using the base member 10 in this manner is advantageous because the person can carry their street shoes with them while they are skating and can easily change between street shoes and in-line skates in case they stop and have to walk into a store, restaurant, concessions booth, or other business establishment. Additionally, the user does not have to leave their street shoes unattended while they are skating.

While the invention has been described in conjunction with a specific embodiment thereof, it is evident that different alternatives, modifications, and variations will be apparent to those in the art in view of the foregoing description. Accordingly, the invention is not limited to these embodiments or the use of elements having specific configurations and shapes as presented herein.

The claimed invention is:

1. An apparatus for carrying in-line skates, the in-line skates having blades, the blades including at least two adjacent wheels, the apparatus comprising:

a base member having a front, back, and bottom, the base member defining first and second slots each open to the bottom and extending from the front to the back, the first and second slots each being sized to receive the blade of an in-line skate so that the base member is substantially perpendicular to the in-line skate blades, the base member further defining first and second strap slots, the first and second strap slots each having a first end open proximal to the bottom and a second open proximal to the top; and a strap, the strap having first and second end portions operably connected to the base member, the strap having a first boot portion extending across the first slot, a first internal portion extending through the first strap slot, a handle portion proximal to the top of the base member, a second internal portion extending through the second strap slot, and a second boot portion extending across the second slot.

2. The apparatus of claim 1 wherein the first and second slots each have an upper surface, each upper surface being configured to fit between adjacent wheels that form a part of the in-line skate blade.

3. The apparatus of claim 2 wherein the base member further defines first and second inner slots configured to receive ice skate blades, the first inner slot being open to the upper surface of the first slot and extending from the front of the base member to the back of the base member, the second inner slot being open to the upper surface of the second slot and extending from the front of the base member to the back of the base member.

4. The apparatus of claim 1 wherein the base member defines first and second hockey-stick slots, the first and second hockey-stick slots each being sized to receive the handle of a hockey stick, the first and second hockey-stick slots each extending from the front to the back of the base member.

5. The apparatus of claim 4 further comprising first and second linings positioned within the first and second hockey-stick slots, respectively, the first and second linings being configured to secure a hockey-stick handle in the first and second hockey-stick slots, respectively.

6. The apparatus of claim 1 wherein the base member further defines a shoe-lace slot configured to receive shoe laces.

7. The apparatus of claim 1 wherein the base member further defines first and second shoe-lace slots, each shoe-lace slot being configured to receive shoe laces.

8. The apparatus of claim 1 further comprising a carrying strap operably connected to the base member.

9. The apparatus of claim 8 wherein the carrying strap is a shoulder strap.

10. The apparatus of claim 8 wherein the carrying strap is a waste strap.

11. An apparatus for carrying in-line skates, the in-line skates having blades, the blades including at least two adjacent wheels, the apparatus comprising:

a base member having a front, back, and bottom, the base member defining:

first and second slots each open to the bottom and extending from the front to the back, the first and second slots each being sized to receive the blade of an in-line skate so that the base member is substantially perpendicular to the in-line skate blades;

first and second inner slots configured to receive ice skate blades, the first inner slot being open to the upper surface of the first slot and extending from the front of the base member to the back of the base member, the second inner slot being open to the upper surface of the second slot and extending from the front of the base member to the back of the base member; and first and second strap slots, the first and second strap slots each having a first end open proximal to the bottom and a second open proximal to the top; and a strap, the strap having first and second end portions operably connected to the base member, the strap having a first boot portion extending across the first slot, a first internal portion extending through the first strap slot, a handle portion proximal to the top of the base member, a second internal portion extending through the second strap slot, and a second boot portion extending across the second slot.

12. The apparatus of claim 11 wherein the first and second slots each have an upper surface, each upper surface being configured to fit between adjacent wheels that form a part of the in-line skate blade.

13. The apparatus of claim 12 wherein the base member defines first and second hockey-stick slots, the first and second hockey-stick slots each being sized to receive the handle of a hockey stick, the first and second hockey-stick slots each extending from the front to the back of the base member.

14. An apparatus for carrying in-line skates, the in-line skates having blades, the blades including at least two adjacent wheels, the apparatus comprising:

a base member having a front, back, and bottom, the base member defining:

first and second slots each open to the bottom and extending from the front to the back, the first and second slots each being sized to receive the blade of an in-line skate so that the base member is substantially perpendicular to the in-line skate blades, the first and second slots each having an upper surface, each upper surface being configured to fit between adjacent wheels that form a part of the in-line skate blade;

first and second inner slots configured to receive ice skate blades, the first inner slot being open to the upper surface of the first slot and extending from the front of the base member to the back of the base member, the second inner slot being open to the upper surface of the second slot and extending from the front of the base member to the back of the base member;

first and second hockey-stick slots, the first and second hockey-stick slots each being sized to receive the handle of a hockey stick, the first and second hockey-stick slots each extending from the front to the back of the base member; and first and second strap slots, the first and second strap slots each having a first end open proximal to the bottom and a second open proximal to the top; and a strap, the strap having first and second end portions operably connected to the base member, the strap having a first boot portion extending across the first slot, a first internal portion extending through the first strap slot, a handle portion proximal to the top of the base member, a second internal portion extending through the second strap slot, and a second boot portion extending across the second slot.

* * * * *